US008807018B2

(12) United States Patent
Doleac et al.

(10) Patent No.: US 8,807,018 B2
(45) **Date of Patent: *Aug. 19, 2014**

(54) CAPSULE WITH REDUCED DRIPPING

(75) Inventors: Frédéric Doleac, Vaux et Chantegrue (FR); Jean-Paul Denisart, La Conversion (FR); Jean-Luc Denisart, Cully (CH); Zenon Loannis Mandralis, Chexbres (CH); Abdelmalek Benelmouffok, Nyon (CH)

(73) Assignee: Nestec S.A., Vevey (CH)

( * ) Notice: Subject to any disclaimer, the term of this patent is extended or adjusted under 35 U.S.C. 154(b) by 1214 days.

This patent is subject to a terminal disclaimer.

(21) Appl. No.: 12/303,310

(22) PCT Filed: Jun. 1, 2007

(86) PCT No.: PCT/EP2007/055382

§ 371 (c)(1),
(2), (4) Date: Jul. 9, 2010

(87) PCT Pub. No.: WO2007/141202

PCT Pub. Date: Dec. 13, 2007

(65) Prior Publication Data

US 2010/0282091 A1 Nov. 11, 2010

(30) Foreign Application Priority Data

Jun. 6, 2006 (EP) ..... 06011671

(51) Int. Cl.
*A47J 31/44* (2006.01)
*B65D 85/804* (2006.01)

(52) U.S. Cl.
CPC ..... *B65D 85/8043* (2013.01)
USPC ..... 99/295

(58) Field of Classification Search
USPC ..... 99/295, 300, 279; 426/77, 80, 115, 78, 426/89, 90; 210/167.05, 532.1, 533, 535, 210/130, 133, 137
See application file for complete search history.

(56) References Cited

U.S. PATENT DOCUMENTS 3,783,590 A * 1/1974 Allen ..... 96/419
3,984,318 A * 10/1976 Bumb ..... 210/130

(Continued)

FOREIGN PATENT DOCUMENTS

CN 1635956 7/2005
EP 1 580 144 9/2005

(Continued)

OTHER PUBLICATIONS

European Search Report EP 06011671 dated Feb. 7, 2007.

(Continued)

*Primary Examiner* — Dana Ross
*Assistant Examiner* — Frederick Calvetti
(74) *Attorney, Agent, or Firm* — Winston & Strawn LLP

(57) ABSTRACT

The invention relates to a capsule containing ingredients for producing a beverage, wherein the ingredients are housed in a compartment and an internal perforation mechanism is provided for opening the lower face of the compartment by using pressure inside the compartment to cause the lower face to act against the perforation member to allow the beverage to exit the capsule through a beverage outlet. The capsule is provided with a valve arranged for selectively blocking the flow path of the beverage to the beverage outlet of the capsule to prevent dripping of the beverage from the compartment after dispensing.

21 Claims, 5 Drawing Sheets

(56) References Cited

U.S. PATENT DOCUMENTS

| | | | | |
|---|---|---|---|---|
| 4,677,447 | A * | 6/1987 | Nielsen | 347/87 |
| 6,171,482 | B1 * | 1/2001 | Nichols | 210/130 |
| 6,477,956 | B1 * | 11/2002 | Rea et al. | 101/466 |
| 8,147,887 | B2 * | 4/2012 | Dogan et al. | 426/77 |
| 2003/0056661 | A1 * | 3/2003 | Hu et al. | 99/495 |
| 2003/0226449 | A1 * | 12/2003 | Carasso et al. | 99/279 |
| 2005/0155491 | A1 * | 7/2005 | Faust et al. | 96/108 |
| 2006/0254428 | A1 * | 11/2006 | Glucksman et al. | 99/302 P |
| 2007/0062378 | A1 * | 3/2007 | Glucksman et al. | 99/279 |
| 2010/0034929 | A1 * | 2/2010 | Dogan et al. | 426/89 |

FOREIGN PATENT DOCUMENTS

| | | | |
|---|---|---|---|
| EP | 1 710 172 | B1 | 11/2006 |
| HU | 0402612 | A2 | 4/2005 |
| TW | 200302195 | A | 8/2003 |
| TW | 200524793 | A | 8/2005 |
| TW | 200531665 | | 10/2005 |
| TW | 200610716 | A | 4/2006 |
| WO | WO 03059778 | A2 | 7/2003 |
| WO | WO 2005/092160 | A1 | 6/2005 |
| WO | WO 2006/021405 | A2 | 3/2006 |
| WO | WO 2006/021406 | A2 | 3/2006 |

OTHER PUBLICATIONS

International Search Report PCT/EP2007/055382 Dated Aug. 28, 2007.

* cited by examiner

CAPSULE WITH REDUCED DRIPPING

This application is a 371 filing of International Patent Application PCT/EP2007/055382 filed Jun. 1, 2007.

BACKGROUND

The present invention generally relates to the field of producing beverages or other liquid comestibles (soups etc.) using an ingredient-containing capsule.

When a beverage production machine injects a liquid, such as for example water, into the interior of the ingredient-containing capsule, the water interacts with the ingredients contained in the capsule. The result of the interaction is a beverage or a liquid comestible, which can then be obtained from the capsule.

EP 1 580 144 A1 relates to an integrated cartridge for extracting a beverage comprising a valve which opens under the effect of pressure. The valve is utilized for delaying the opening of the cartridge. The valve enables a rise in pressure in the cartridge and it improves the extraction as well as the foam formation. The valve also reduces the dripping of fluid residuals when the extraction is terminated. Therefore, the valve has different functions one of which is the control of the inside pressure. This is difficult to produce a valve which is reliable enough and can always control the same extraction pressure. Furthermore, the capsule must be hermetically sealed and therefore it must opened by an additional tappet before the start of the extraction process such as manually or by insertion in the beverage preparation machine.

SUMMARY OF THE INVENTION

The invention resolves the disadvantages of the prior art in proposing a solution for a sealed capsule which better controls the extraction pressure and provides a suitable solution to the problem of dripping of fluid residuals.

The invention particularly relates to the field of capsules in which, during manufacture of the capsule, the ingredients are hermetically sealed in a compartment of the capsule. In other words, an exposure of the ingredients to the ambience is only produced after the capsule has been inserted into a beverage production machine, which usually has means for perforating an inlet face of the capsule, means for injecting water into the capsule and means for carrying the capsule in a defined position.

The hermetically sealed capsule is of advantage as it avoids a premature loss of volatile substances of the ingredients during transport or storage.

At the end of the beverage production process the capsule is opened both at an inlet side and at an outlet side. Although the biggest portion of the liquid introduced into the interior of the capsule will be drained from the water, there will always some residual liquid remaining in the capsule after the beverage production process.

Particularly when the capsule is then taken out from the beverage production machine, there is the problem of water or beverage dripping e.g. from the water inlet side of the capsule. It is thought that this dripping is particularly promoted by air entering the capsule from the beverage outlet side.

Sometimes this problem is even aggravated when the beverage leaving the water inlet side of the capsule causes even solids such as coffee powder to leave the capsule on the water inlet side. This can lead to a cross-contamination of elements of the beverage production machine, which constitutes a particular problem when the beverage production machine is used for different beverages (e.g. coffee, tea, juice, milk . . . ).

The invention therefore has the object to reduce the risk of residual liquids and/or solids leaving the capsule after the completion of the beverage production process.

According to a first aspect, a capsule is proposed containing ingredients for producing a beverage or liquid comestible. The ingredients are housed in a compartment. A lower face of the compartment is designed for the release of beverage out of the ingredient compartment under the effect of the pressure building up inside the ingredient compartment. The lower face is permanently opened under the effect of the rise in pressure in the capsule. This pressure is typically caused by the injection of water into the ingredient compartment. Additionally, the capsule is provided with valve means arranged for selectively blocking the flow path from said face of the ingredient compartment to a beverage outlet of the capsule. The valve is designed to block the flow of beverage when the pressure is sufficiently reduced. As a result, dripping of residual liquid is prevented at the end of the preparation process.

Internal perforation means can be provided for opening the lower face under the effect of the pressure inside the ingredient compartment by causing the lower face and the perforation means to engage with each other in order to perforate or otherwise open the lower face. "Lower face" has to be understood as the face which upon opening opens a flow path towards a beverage outlet of the capsule.

The valve means can be designed to block the flow path in an essentially airtight fashion. This constitutes one possibility of implementing the general idea of reducing or at least inhibiting a flow of air through the capsule after the completion of the beverage production process.

The valve means can be preferably placed downstream of the lower face. This constitutes one possibility to hinder a fluid flow (in at least one direction) between the ingredient compartment and a beverage outlet opening of the capsule.

The valve means can be designed to open the flow path selectively, i.e. only when the pressure inside the ingredient compartment is made higher than ambient pressure or generally, as soon as the beverage production process is finished, i.e. as soon as the liquid injection into the ingredient compartment stops.

Correspondingly, the valve means can be designed to block the flow path as soon as the pressure inside the ingredient compartment does no longer exceed the ambient pressure.

The capsule can be provided with perforation means having the general shape of a contoured plate. The contours, e.g. pins or pyramids, are designed to assist to the opening of an adjacent face of the ingredient compartment. The valve means can be arranged at the periphery of the plate. Especially the valve means can be an integral part of the plate.

The valve means can comprise a flexible lip arranged to engage in closure the adjacent wall of the capsule and be biased in opening by effect of the pressure so as to disengage from the adjacent wall.

A further aspect of the present invention relates to a capsule, which is designed for injecting a liquid into an n ingredient compartment through an opening in an inlet face of the capsule and for draining a beverage from a beverage outlet of the capsule. The capsule comprises means for auto-closing off or at least largely reducing a flow of air between the beverage outlet and the opening in the inlet face of the capsule, and vice-versa, as soon as the liquid injection into the ingredient compartment ceases.

The invention also relates to a capsule in which the valve means are designed to be mechanically opened and closed by cooperating control means arranged outside the capsule.

The valve means can be designed to cooperate with external control means, which can be protrusions in a capsule carrier of a beverage production machine.

The valve means can be formed by a peripheral sealing surface of an inner contoured plate of the capsule, which is selectively disengaged from the inner wall of a body of the capsule as a result of the protrusions acting in compression to inwardly deform the outer wall of the capsule and push the plate.

The valve means can be opened as a result of the compression exerted on the capsule and the capsule carrier when the capsule is placed on the capsule carrier and the capsule is engaged by injection means of the beverage production machine.

A still further aspect of the present invention relates to a capsule containing ingredients for producing a beverage. The ingredients are housed in a compartment. Internal opening means can be provided for opening the lower face of the ingredient compartment by having, caused by pressure inside the ingredient compartment, the lower face act against the opening means. Thereby the flow path from the lower face of the ingredient compartment to a beverage outlet of the capsule can comprise a chicane section designed for breaking the speed of the beverage flowing to the beverage outlet. A chicane section refers to a section, which changes the flow of the beverage at least once such that the beverage flow impinges on a fixed wall, which breaks the energy of the beverage jet.

The opening means can comprise a contoured plate including at least one perforation element arranged to engage the lower face of the compartment.

The chicane section can be at least partially defined by a bead in the outer wall of the capsule shell and the portion of wall of the contoured plate.

A still further aspect of the present invention relates to a capsule containing ingredients for producing a beverage. An inlet face of the capsule is designed for injecting a liquid under pressure through an opening provided or generated in the inlet face. Means are provided for automatically closing off the opening after liquid injection means are retracted from the capsule and/or as soon as the liquid injection stops.

The inlet face of the capsule can be made from a material having self-closing characteristics ("self-healing characteristics").

The self-closing means can be made e.g. from a resilient material. These self-closing means can be made from a silicone or elastomer material applied to the inner side and outer side of the inlet face.

A still further aspect of the present invention relates to a capsule containing ingredients for producing a beverage. The ingredients are housed in a compartment. Internal perforation means are provided designed for opening the lower face of the ingredient compartment by having, caused by pressure inside the ingredient compartment, the lower face act against the internal perforation means. The flow path from the lower face of the ingredient compartment to a beverage outlet of the capsule follows essentially the inner side of the outer walls of the capsule. Beverage flow guiding means are provided for having the beverage leaving the beverage outlet essentially in the centre of the beverage outlet.

The flow guiding means can be a pin arranged in the centre of the beverage outlet.

The pin can be at least partially tapered to the outside.

The perforation means can have the shape of a contoured plate and the flow guiding means can be integrated and protrude from the lower side of the contoured plate.

A still further aspect of the present invention relates to a capsule containing ingredients for producing a beverage, wherein an inlet face of the capsule is provided with an integrated liquid port, which is adapted to be coupled to liquid injection means of a beverage production machine. The integrated liquid port can protrude from the inlet face of the capsule.

BRIEF DESCRIPTION OF THE DRAWINGS

Further aspects, objects and advantages of the present invention will become evident from the following description of preferred embodiments of the present invention taken in conjunction with the figures of the enclosed drawings.

DETAILED DESCRIPTION OF THE PREFERRED EMBODIMENTS

Figure 1:
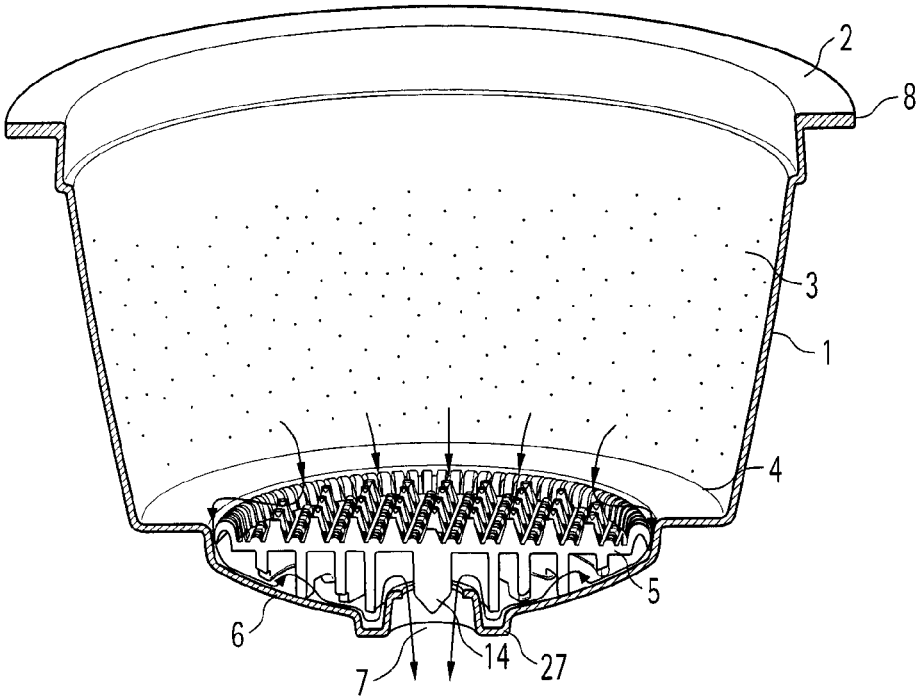
FIG. 1 shows a cross-sectional view of a capsule according to the present invention.

With reference to FIG. 1 at first the general principle to be applied with the present invention will be explained.

FIG. 1 shows a capsule 1 having an ingredient compartment 3, i.e. a sealed compartment 3 which can contain beverage or liquid comestible ingredients. Before the use of the capsule 1 in an associated adapted beverage production machine, the ingredient compartment 3 is hermetically sealed against the exterior.

Attaching a foil, membrane, etc. to the upper flange-like extension 8 of the capsule walls can e.g. seal the top surface 2 in an airtight fashion. As will be explained later on in detail with reference to FIGS. 5 and 6, the upper sides 2 can be opened e.g. by perforating it with external perforation means, i.e. perforation means which are part of the beverage production machine.

According to the invention, the outlet side 4 of the ingredient compartment 3 is opened by the effect of increasing the pressure inside the ingredient compartment 3 above the ambient pressure, i.e. the pressure outside the capsule 1. To this regard, the face 4 of the ingredient compartment 3 to be opened can be made to engage with opening means which can be housed in the capsule 1 (as shown in the embodiment of FIG. 1) or which can be means which are external to the capsule 1.

In any case, when injecting e.g. water into the ingredient compartment 3, the lower face 4 will increasingly be engaged with the opening means until a certain threshold value is reached and the lower face 4 will open against the perforation means 5.

In the embodiment shown in FIG. 1, which is meant to be a non-limiting illustration only, the lower face 4 acts against a perforation means 5 which are integrated into the capsule 1.

Figure 2:
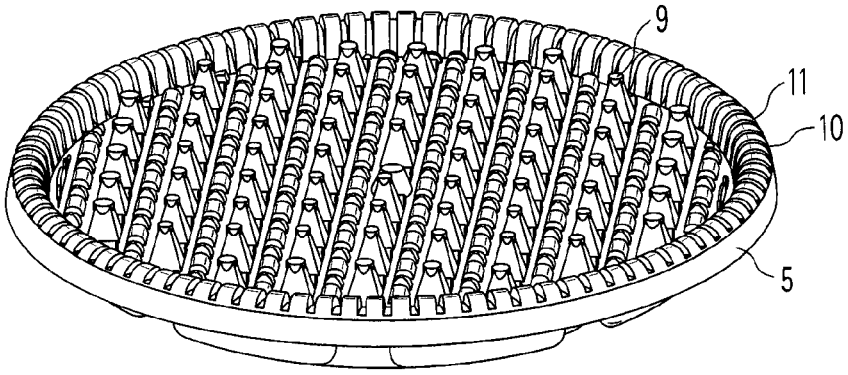
FIG. 2 shows a view of a perforation plate according to the present invention.

Particularly, as can also be seen in detail in FIG. 2, the opening means can be a contoured plate 5, such as for example a plate 5 having at the side opposing with the lower face 4 of the ingredient compartment 3, protrusion such as for example little pyramids 9.

Thus, when increasing the pressure inside the ingredient compartment 3, the lower face will eventually tear against the pyramids 9 of the perforation plate 5.

The shown perforation plate, thus, is designed to generate a plurality of openings in the lower face 4 and a beverage being the product of the interaction of the water with the ingredients and the ingredient compartment 3 will flow through these plurality of openings into the interstices between the side walls of the pyramids 9 of the perforation plate 5.

The perforation plate 5 preferably has no openings, such that the beverage from the ingredient compartment 3 is forced to flow towards the periphery 10 of the perforation plate 5.

The periphery 10 of the perforation member 5 is provided with little slots 11 allowing the beverage to flow to the circumferential wall of the perforation plate 5.

The beverage flow is schematically illustrated in FIG. 1 by little arrows.

When the ingredient compartment 3 is pressurized, the liquid will be able to flow in a space between the perforation plate 5 and associated conical walls 6 of the capsule 1 towards a beverage outlet 7 of the capsule.

Therefore, in the region of the conical walls 6 the beverage flow essentially follows the inner side of the capsule walls 6.

Means can be provided for ensuring that the beverage leaves the beverage outlet 7 in a smooth manner. These means can e.g. be a guiding pin 14 arranged in the centre of the beverage outlet opening 7. The guiding pin 14 can be an integral part of the perforation plate 5 and protrudes downwards from the lower face of the perforation plate 5. Preferably, the guiding pin 14 tapers at its lower section outwardly.

Therefore, the beverage coming from the periphery of the perforation plate 5 will be smoothly guided by the cooperation of the beverage outlet opening 7 and the guiding pin 14 and preferably leave the capsule 1 in a steady flow.

This is particularly of importance in case the so-called "direct-flow" principle is used. According to the direct-flow principle, the beverage leaving the beverage outlet opening 7 of the capsule 1 is made to directly flow into a cup or another receptacle without any additional guidance by parts of the beverage production machine. As there is no additional guidance of the beverage flow leaving the capsule 1, it has to be ensured that the beverage leaves this beverage outlet opening 7 smoothly in order to avoid the beverage splashing into the cup or another receptacle.

Note that according to the direct-flow principle, the capsule 1 does not necessarily have to be arranged in a vertical orientation as indicated in FIG. 1, but can also be arranged in any position inclined to the vertical, such as for example a horizontal position. While in the position as shown in FIG. 1 (vertical arrangement) the beverage will leave the beverage outlet 7 in a direction flushing with the rotational symmetrical axis of the capsule 1, the beverage outlet flow will describe an angle towards this symmetry axis of the capsule 1 in case the capsule 1 is arranged in a position inclined to the vertical.

Figure 3:
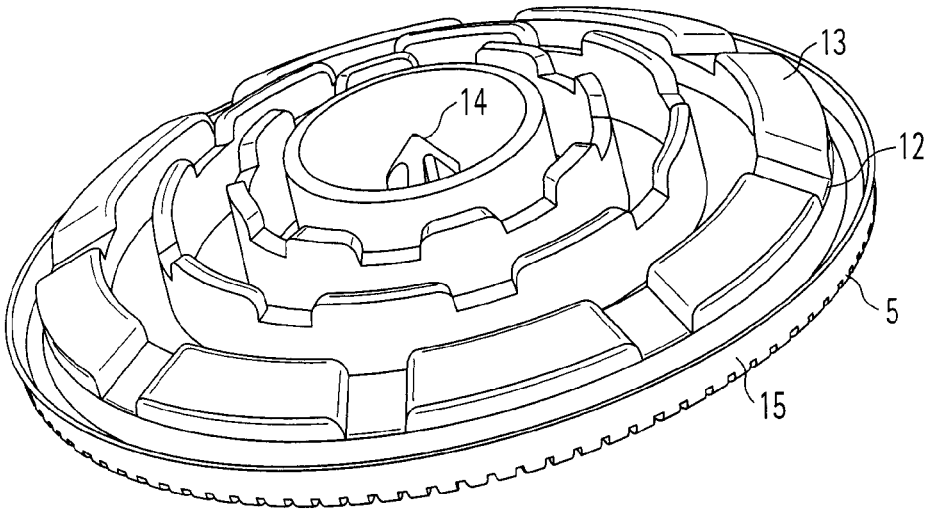
FIG. 3 shows the lower side of the perforation plate of FIG. 2.

In addition or alternatively to the guarding pin 14 further measures can be taken in order to promote a smooth flow of the beverage coming from the beverage ingredient compartment 3. As shown in FIG. 3, the lower side of the perforation plate 5 can be provided with several rings 13 arranged coaxially to the centre of the perforation plate 5, in which centre the guiding pin 14 can be arranged.

The coaxial rings 13 are respectively provided with a plurality of recessions 12, wherein recessions 12 of neighbouring rings 13 are offset relative to each other regarding their angular position when measured to the centre of the perforation plate 5.

The areas of the rings 13 outside the recessions 12 can be made to be in full contact with the associated walls 6 of the capsule 1 or at least such that they represent a flow obstacle for the beverage stream.

Figure 4:
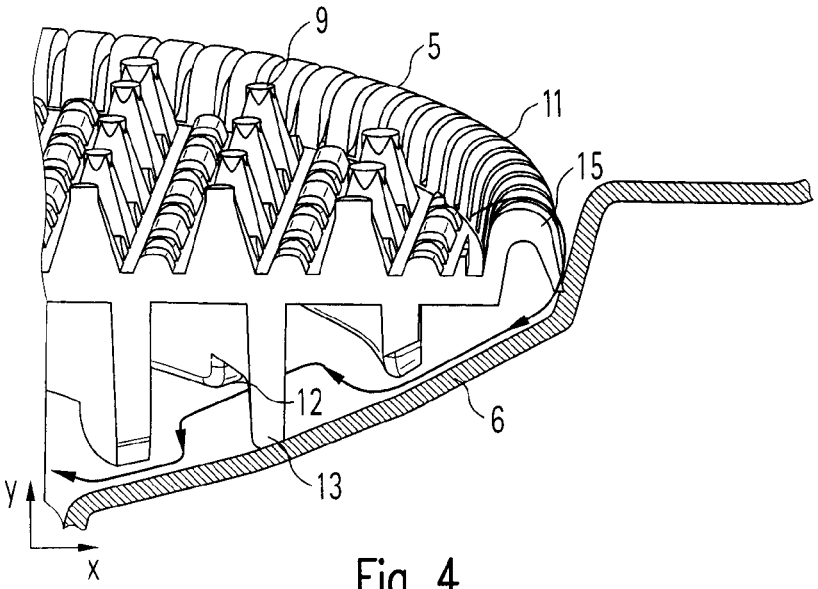
FIG. 4 shows an enlarged view of the engagement between the perforation plate and the adjacent walls of the capsule.

In any case, as indicated in FIGS. 1 and 4, the cooperation of the offset recessions 12 with the wall 6 of the capsule 1 will force the beverage into a meandering (tortuous) path, wherein the walls defining the path break the energy of the beverage jet and promote a smooth flow towards the beverage outlet opening 7.

Additionally, in the area surrounding the beverage outlet 7, the walls 6 of the capsule 1 can be provided with an outwardly extending bead 27, which also promotes a steady flow and an energy-breaking effect of the beverage jet.

As can be seen from FIGS. 3 and 4, the periphery 10 of the perforation plate 5 can be provided with a flexible lip 15, which is biased against the wall 6 of the capsule. When seen in the flow-direction of the beverage flow path, the lip 15 can form an acute angle with the associated wall 6 of the capsule 1. As long as the ingredient compartment 3 is pressurized, the beverage flow 15 will be able to push the flexible lip 15 inwards in order to open a flow path.

The flexible lip 15 thus represents just one illustrative embodiment for having a selective valve means, which closes the flow path from the ingredient compartment 3 to the beverage outlet 3 in case the beverage ingredient compartment 3 is not pressurized. Thus, as soon as the water injection into the ingredient compartment 3 stops, the flexible lip 15 will shut off the flow path. Thus, e.g. any remaining water in the ingredient compartment 3 or on the top surface of the perforation plate can no longer exit towards the beverage outlet opening 7.

Additionally, the valve means, such as for example the flexible lip 15, can be made to cut-off even any airflow between the exit opening 7 and the water injection opening produced in the inlet side 2 of the capsule 1. This has the advantage that by at least drastically reducing the air flow through the capsule 1, the amount of liquid or solids which can leave the interior of the capsule 1 e.g. through the injection opening at the top surface 2 of the capsule can be reduced for a lack of compensating air.

Note that many different valve arrangements and positions for the valve can be thought of, as long as the valve means are adapted to be at least an obstacle through to a flow of air and/or liquid between the beverage outlet opening 7 and the water injection opening at the top surface 2, and vice-versa.

FIGS. 5*a*-5*c* as well as FIGS. 6*a*-6*c* show alternative means for prohibiting liquid and/or solids leaving an opening 18 in the top surface 2 of the capsule 1 which opening 18 is produced by introducing the water injection means 16.

Figure 5:
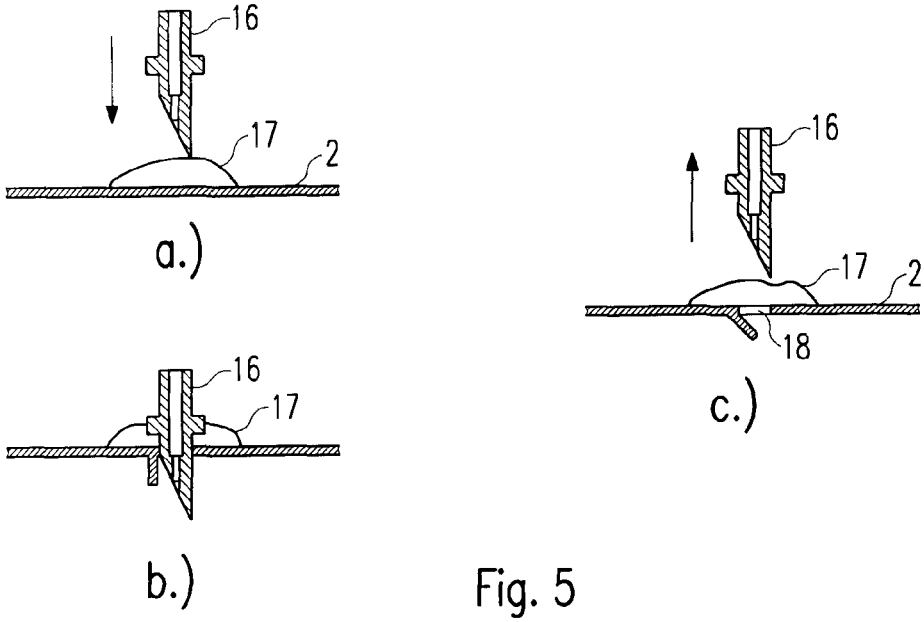
FIG. 5 shows a first embodiment for an automatic reclosing of the inlet face of the capsule after retraction of water injection means.
Figure 6:
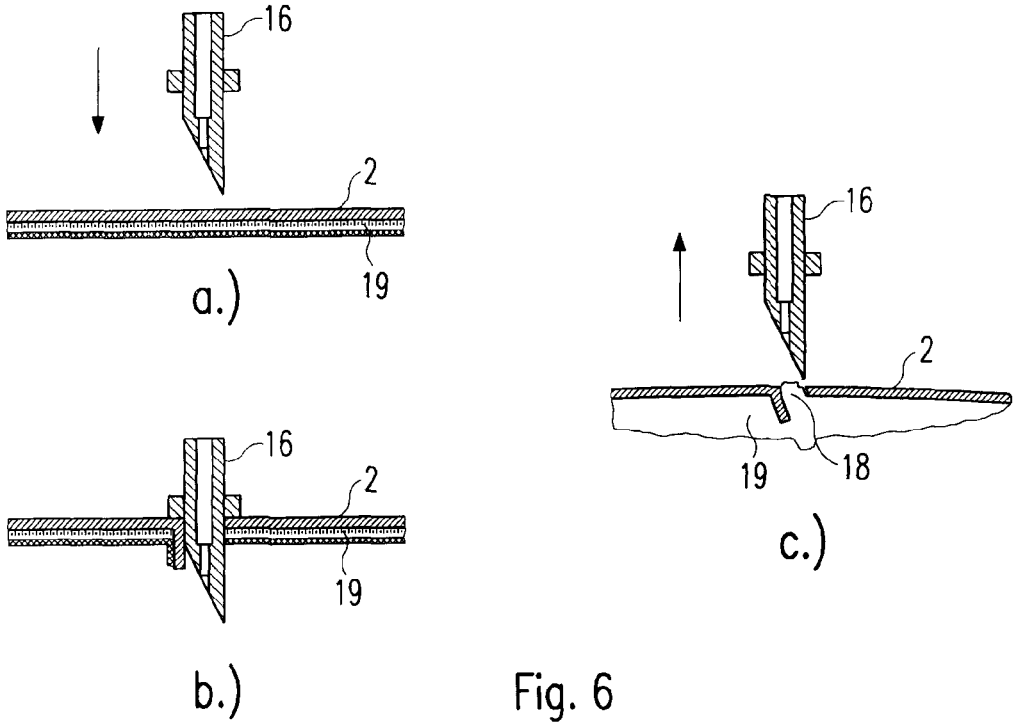
FIG. 6 shows a second embodiment for auto-closing means of the perforation in the inlet face of the capsule.

In the embodiment of FIG. 5 a self-healing material 17 is attached to the upper side and/or the lower side of the top surface 2. As shown in FIGS. 5*a*-5*c*, the water injection means 16 will go through the self-healing material 17 as well as the foil or membrane of top surface 2. Once the water injection is completed, the water injection means 16 will be retracted (FIG. 5*c*) leaving an opening 18 at the top surface 2. According to the invention the material 17 is e.g. an elastomer, a silicone material etc. which is enable to "heal" automatically the opening made by the water injection means 16.

FIGS. 6*a*-6*c* show a slightly different approach in which self-healing material forming a layer 19 is attached to the interior of the top surface. Again, both the top surface 2 material as well as the self-healing material 19 will be perforated by the perforation means 16 in order to carry out the water injection. Once the water injection and perforation means 16 are retracted (FIG. 6*c*), the expanding material 19 will heal the opening 18 left by the water injection perforation member 16. The expanding material 19 can e.g. be made from a super-absorbing polymer (SAP) which can take up e.g. up to 100 times of its own weight of water. A layer of this expanding material 19 can be installed e.g. as an inner film or by hot melting under a membrane forming the top surface 2. The expanding material can e.g. absorb water and then be transformed into a gel, which blocks the opening 18.

Figure 7:
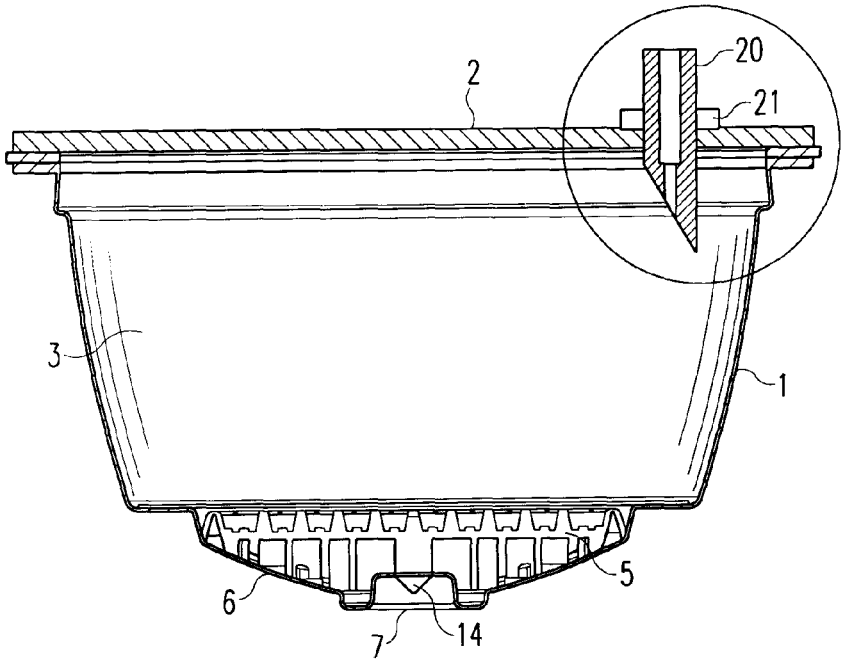
FIG. 7 shows a capsule with integrated water inlet port.
Figure 8:
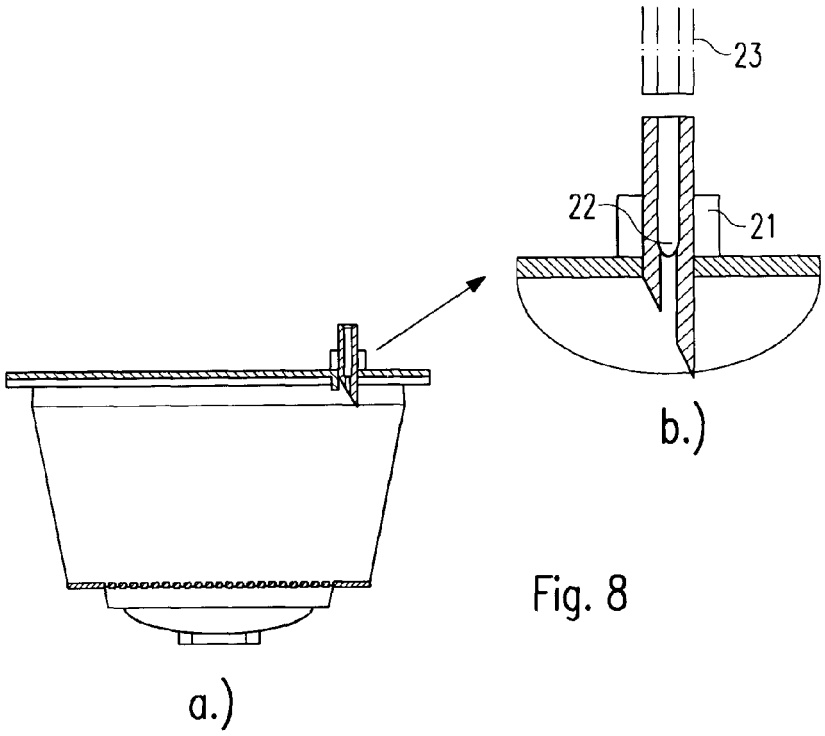
FIG. 8 shows details of the functionality of the water inlet port of the capsule according to FIG. 7.

FIG. 7 shows an embodiment of the capsule 1 which is provided with its own water injection port 20. The water injection port 20, being sealed via means 21 vis-à-vis the top surface 2 of the capsule 1, is part of the capsule 1 and not of the associated beverage production machine. As can be seen for example from FIG. 8*b*, a water injection port 23 can be docked in a seal fashion to the port 22 of the capsule 1. As can be schematically seen in FIG. 8*b*, preferably the water injection port 22 of the capsule 1 has a relatively small diameter in order to promote a capillarity effect. E.g., if the inner diameter of the water injection port 22 is between some 0.1 and 0.3 mm, a capillary effect will occur which retains water inside the port 22 even after the water injection pipe 23 of the beverage production device is removed. The water remaining in the form of a meniscus inside the port 22 will then represent an air barrier, i.e. air ingress is avoided and the loss of residual liquid from the capsule is reduced.

Figure 9:
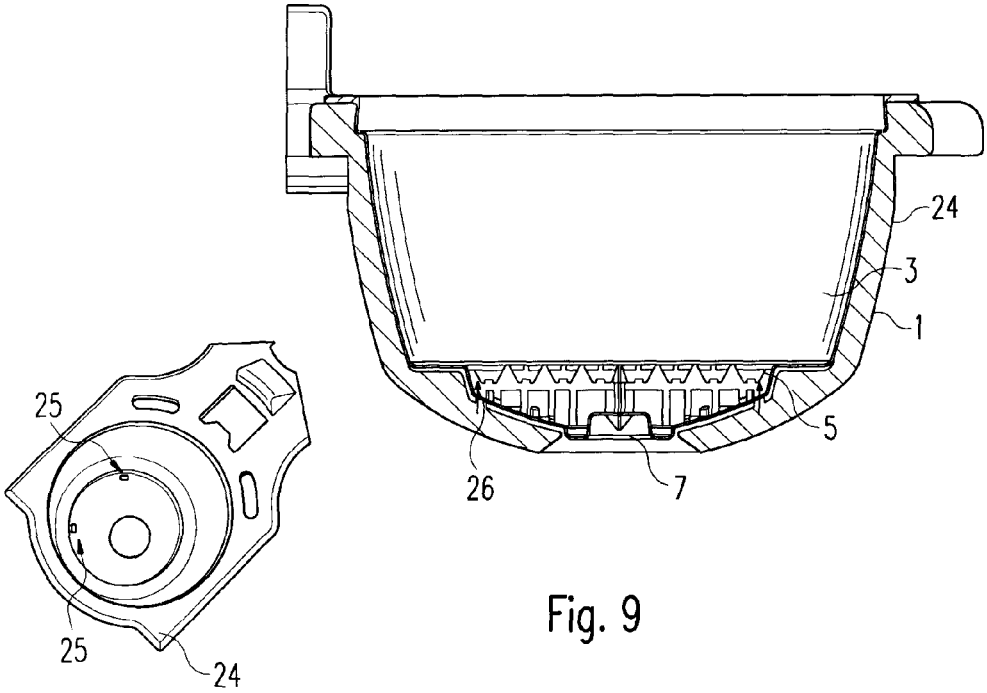
FIG. 9 shows a further embodiment illustrating one possibility to mechanically control valve means inside the capsule via control means placed outside the capsule.

FIG. 9 shows an embodiment of a capsule 1 being an example for having external control means for controlling the valve means inside the capsule in order to stop air and/or liquid flow inside the capsule once the water injection is stopped.

According to the embodiment on FIG. 9 the capsule holder 24 in which the capsule 1 is inserted for use with the beverage production machine is provided with two bosses 25 which urge against the wall of the capsule 1 at a defined position 26 when the capsule 1 is inserted under thrust into the capsule carrier 24.

Thus, as long as the capsule 1 is thrust against the bosses 25, these bosses 25 will press the portion 26 of the capsule walls slightly inside and will thus slightly lift the perforation member 5 relative to the associate wall of the capsule 1.

Preferably, the perforation plate 5 is provided with sealing means such as for example the flexible lip 15 (see for example FIGS. 3 and 4). Therefore, as long as the perforation plate 5 is lifted by the engagement with the bosses 25 of the capsule carrier 24, the beverage can flow around the periphery of the perforation plate 5 and can flow to the beverage outlet opening 7 of the capsule 1. However, as soon as the thrust against the portions 26 of the capsule walls ceases, e.g. because the capsule 1 is separated from the capsule carrier 24, the perforation plate 5 will resume its initial position in which it is seated such that it shuts off the flow of air and/or liquid between the ingredient compartment 3 and the beverage outlet opening 7.

What is claimed is:

1. A beverage forming capsule comprising a compartment containing ingredients for producing a beverage and having a beverage outlet, the compartment comprising a peripheral wall and a lower face in contact with the compartment peripheral wall which the lower face is designed to initially support the ingredients at ambient pressure while preventing flow of the beverage therethrough, and thereafter to release the beverage from the compartment along a flow path that is directed first towards the peripheral wall of the compartment and then towards the beverage outlet when pressure in the compartment increases to cause the lower face to be permanently opened; and valve means operatively associated with the peripheral wall of the compartment and having a peripheral portion that is movable under the effect of pressure inside the capsule, with the valve means being arranged and positioned for selectively blocking the flow path such that the beverage is allowed to flow first towards the peripheral wall of the compartment, then between the peripheral portion of the valve means and the peripheral wall of the compartment under the increased pressure after the lower face is permanently opened, and then through the beverage outlet, with the peripheral portion of the valve means then closing the flow path from the compartment to the beverage outlet to prevent flow of the beverage after the increased pressure is reduced back to ambient pressure, wherein the valve means includes a valve member comprising a contoured plate that includes perforation means for permanently opening the lower face, and the peripheral portion comprises a flexible peripheral lip for blocking the flow path in an airtight fashion at ambient pressure by engaging the compartment peripheral wall at the periphery of the contoured plate and to open the flow path by inward movement of the peripheral portion only when the pressure inside the compartment is higher than ambient pressure, wherein the valve member is positioned below the lower face and the perforation means includes contours for perforating the lower face such that the lower face is permanently opened by engagement with the contours due to the increased pressure in the compartment.

2. The capsule according to claim 1, wherein the contours include pins or pyramids, the contoured plate includes top and bottom sides with the top side facing the lower face and including the pin or pyramid contours, and the bottom side of the contoured plate including a plurality of coaxial rings and recessions, wherein recessions of neighboring rings are offset relative to each other.

3. The capsule according to claim 1 further comprising an inlet face on the capsule for injection of a liquid, the capsule being designed for receiving a liquid by injection through an opening generated in the inlet face by puncture of the inlet face by liquid injection means; and means for automatically closing the inlet face injection opening placed adjacent the inlet face and comprising a material that automatically heals after removal of the injection means from the injection opening.

4. The capsule according to claim 3, wherein the automatic closing means is made of a material that expands sufficiently after removal of the injection means to close the opening in the inlet face.

5. The capsule according to claim 4, wherein the material of the automatic closing means is a super-absorbing polymer (SAP).

6. The capsule according to claim 3, wherein the automatic closing means is a pad of resilient material.

7. The capsule according to claim 6, wherein the material of the pad is an elastomer or silicone material.

8. A beverage forming capsule comprising a compartment containing ingredients for producing a beverage and having an inlet face, a peripheral wall, and a beverage outlet, the capsule being designed for receiving a liquid by injection through an opening provided or generated in the inlet face and for draining a beverage from the beverage outlet; and an auto-closing off mechanism for automatically blocking air flow between the beverage outlet and the inlet face opening or vice-versa as soon as liquid injection ceases, wherein the auto-closing off mechanism comprises:

valve means operatively associated with the peripheral wall of the compartment and having a peripheral portion that is movable under the effect of pressure inside the capsule, with the valve means being arranged and positioned for selectively blocking air flow such that air flow is allowed towards the peripheral wall of the compartment, then between the peripheral portion of the valve means and the peripheral wall of the compartment under increased pressure provided by the liquid injection, and then through the beverage outlet but air flow is automatically blocked by closure of the peripheral portion of the valve means as soon as the liquid injection ceases, wherein the valve means includes a valve member comprising a contoured plate that includes perforation means for permanently opening the lower face, and the peripheral portion comprises a flexible peripheral lip for blocking the flow path in an airtight fashion at ambient pressure by engaging the compartment peripheral wall at the periphery of the contoured plate and to open the flow path by inward movement of the peripheral portion only when the pressure inside the compartment is higher than ambient pressure, wherein the valve member is positioned below the lower face and the perforation means includes contours for perforating the lower face such that the lower face is permanently opened by engagement with the contours due to the increased pressure in the compartment, and means for automatically closing the inlet face opening placed adjacent the inlet face and comprising a material that automatically heals after removal of the liquid injection means.

9. The capsule according to claim 8 further comprising an inlet face on the capsule for injection of a liquid, the capsule being designed for receiving a liquid by injection through an opening generated in the inlet face by puncture of the inlet face by liquid injection means; and means for automatically closing the inlet face injection opening placed adjacent the inlet face and comprising a material that automatically heals after removal of the injection means from the injection opening.

10. The capsule according to claim 9, wherein the automatic closing means is made of a material that expands sufficiently after removal of the injection means to close the opening in the inlet face.

11. The capsule according to claim 10, wherein the material of the automatic closing means is a super-absorbing polymer (SAP).

12. The capsule according to claim 9, wherein the automatic closing means is a pad of resilient material.

13. The capsule according to claim 12, wherein the material of the pad is an elastomer or silicone material.

14. A beverage forming capsule comprising a compartment containing ingredients for producing a beverage and a beverage outlet, the compartment comprising a peripheral wall, a lower face designed to initially support the ingredients, internal opening means for opening the lower face of the compartment to provide a flow path for the beverage by having the lower face act against the internal opening means when pressure inside compartment increases above ambient pressure to allow the beverage to flow along the flow path to the beverage outlet; valve means operatively associated with the opening means and peripheral wall of the compartment, the valve means having a peripheral portion that is movable under the effect of pressure inside the capsule, with the valve means being arranged and positioned for selectively blocking the flow path such that the beverage is allowed to flow towards the peripheral wall of the compartment, then between the peripheral portion of the valve means and the peripheral wall under the increased pressure after the lower face is opened, and then through the beverage outlet but flow of the beverage is prevented by closure of the peripheral portion of the valve means after the increased pressure is reduced back to ambient pressure; and a chicane section designed for braking the speed of the beverage flowing to the beverage outlet, wherein the valve means includes a valve member comprising a contoured plate that includes perforation means for permanently opening the lower face, and the peripheral portion comprises a flexible peripheral lip for blocking the flow path in an airtight fashion at ambient pressure by engaging the compartment peripheral wall at the periphery of the contoured plate and to open the flow path by inward movement of the peripheral portion only when the pressure inside the compartment is higher than ambient pressure, wherein the valve member is positioned below the lower face and the perforation means includes contours for perforating the lower face such that the lower face is permanently opened by engagement with the contours due to the increased pressure in the compartment.

15. The capsule according to claim 14, wherein the opening means comprises a contoured plate including at least one perforation element arranged to engage the lower face of the compartment.

16. The capsule according to claim 14, wherein the chicane section is at least partially defined by a bead in the outer wall of the capsule shell and a portion of wall of the contoured plate.

17. The capsule according to claim 14 further comprising an inlet face on the capsule for injection of a liquid, the capsule being designed for receiving a liquid by injection through an opening generated in the inlet face by puncture of the inlet face by liquid injection means; and means for automatically closing the inlet face injection opening placed adjacent the inlet face and comprising a material that automatically heals after removal of the injection means from the injection opening.

18. The capsule according to claim 17, wherein the automatic closing means is made of a material that expands sufficiently after removal of the injection means to close the opening in the inlet face.

19. The capsule according to claim 18, wherein the material of the automatic closing means is a super-absorbing polymer (SAP).

20. The capsule according to claim 17, wherein the automatic closing means is a pad of resilient material.

21. The capsule according to claim 20, wherein the material of the pad is an elastomer or silicone material.

* * * * *

UNITED STATES PATENT AND TRADEMARK OFFICE

CERTIFICATE OF CORRECTION

PATENT NO. : 8,807,018 B2
APPLICATION NO. : 12/303310
DATED : August 19, 2014
INVENTOR(S) : Doleac et al.

It is certified that error appears in the above-identified patent and that said Letters Patent is hereby corrected as shown below:

Title Page:
Item (76) Inventors, after "Jean-Paul Denisart," change "La Conversion (FR)" to -- La Conversion (CH) --; and change "Zenon Loannis Mandralis" to -- Zenon Ioannis Mandralis --.

Signed and Sealed this
Eleventh Day of November, 2014

Michelle K. Lee

Michelle K. Lee
*Deputy Director of the United States Patent and Trademark Office*